US007889601B2

(12) United States Patent
Goodmote et al.

(10) Patent No.: US 7,889,601 B2
(45) Date of Patent: Feb. 15, 2011

(54) LIGHTWEIGHT ACOUSTIC ARRAY

(75) Inventors: John H. Goodmote, Oneida, NY (US); Dane E. Reiner, Liverpool, NY (US); David J. Erickson, Liverpool, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 329 days.

(21) Appl. No.: 11/820,379

(22) Filed: Jun. 19, 2007

(65) Prior Publication Data

US 2008/0316866 A1 Dec. 25, 2008

(51) Int. Cl.
*H04R 17/00* (2006.01)

(52) U.S. Cl. ..... 367/176; 367/153; 367/162

(58) Field of Classification Search ..... 367/153, 367/162, 165, 176
See application file for complete search history.

(56) References Cited

U.S. PATENT DOCUMENTS

| | | | | |
|---|---|---|---|---|
| 1,378,420 | A | 5/1921 | Merritt | |
| 2,415,832 | A | 2/1947 | Mason | |
| 3,907,062 | A * | 9/1975 | Brigham et al. | 367/153 |
| 4,004,266 | A * | 1/1977 | Cook et al. | 367/165 |
| 4,164,727 | A | 8/1979 | Morris | |
| 4,399,526 | A | 8/1983 | Eynck | |
| 4,674,595 | A | 6/1987 | Henriquez | |
| 4,975,799 | A | 12/1990 | McGee et al. | |
| 5,220,535 | A | 6/1993 | Brigham et al. | |
| 5,331,605 | A | 7/1994 | Hagerty | |
| 5,335,209 | A | 8/1994 | Jaenke et al. | |
| 5,781,509 | A * | 7/1998 | Zehner | 367/153 |
| 5,808,967 | A | 9/1998 | Yu et al. | |
| 6,561,034 | B2 | 5/2003 | Benjamin | |
| 6,690,621 | B2 * | 2/2004 | Porzio | 367/158 |
| 6,711,096 | B1 | 3/2004 | Benjamin | |
| 2006/0111512 | A1 | 5/2006 | Dunham et al. | |

OTHER PUBLICATIONS

Haddle and Skudrzyk, "The Physics of Flow Noise", The Journal of the Acoustical Society of America, 1969, vol. 46, No. 1 (part 2), pp. 130-157.

Folds and Loggins, "Transmisson and reflection of ultrasonic waves in layered media", JASA, Nov. 1977, vol. 62, No. 5, pp. 1102-1109.

Madigosky and Fiorito, "Model resonance analysis of acoustic transmission and reflection losses in viscoelastic plates", JASA, May 1979, vol. 65, No. 5, pp. 1105-1115.

Mott et al., "Acoustic and dynamic mechanical properties of a polyurethane rubber", JASA, Apr. 2002, vol. 111, No. 4, pp. 1782-1790.

(Continued)

*Primary Examiner*—Ian J Lobo
(74) *Attorney, Agent, or Firm*—Howard IP Law Group, P.C.

(57) ABSTRACT

An acoustic transducer array and method of baffle construction is presented to provide an improved array for use in underwater installations. The array is presented wherein a significant majority of the acoustic energy receiving surface is formed by lightweight acoustic baffling material while still maintaining a fully functional, fully populated array. The acoustic baffle constructed is incompressible and suitable for deep water operation while demonstrating both improved acoustic performance and positive buoyancy when necessary. In addition, the invention eliminates the non-uniform element to element spacing that occurs between sub-panels in similar arrays.

11 Claims, 12 Drawing Sheets

OTHER PUBLICATIONS

Ko and Schloemer, Flow noise reduction techniques for a planar array of hydrophones, JASA, Dec. 1992, vol. 92, No. 6, pp. 3409-3424.

Merrill Skolnik, McGraw-Hill, "Radar Handbook", 2nd Edition, Chap. 7, pp. 26-29.

* cited by examiner

LIGHTWEIGHT ACOUSTIC ARRAY

FIELD OF THE INVENTION

The present invention relates generally to underwater acoustic arrays, and more particularly to lightweight, high frequency transducer arrays suitable for conformal installations.

BACKGROUND OF THE INVENTION

Electromechanical transducers are devices that exchange electrical and mechanical energy. Such transducers have acoustic applications, such as in microphone, speaker, underwater projector, hydrophone, sonar, sonic cleaning and imaging, and weaponry applications. Transducers intended for sonar applications typically use solid-state piezoelectric elements. These elements may be made from a variety of materials, such as ferroelectric ceramic lead zirconate titanate (PZT).

In sonar applications, a multiplicity of transducers are typically configured in an array. In addition to increased signal gain and reduced interference provided by an array's directivity, operational modes that produce life-like images and yield accurate estimates of contact bearing, range, and velocity are facilitated.

Underwater transducer arrays and associated acoustic signal conditioning baffles have generally been proposed. For example, U.S. Pat. No. 1,378,420, describes a pressure release surface, sonar baffle, inertia plate, and a general manner of arrangement to implement low frequency passive sonar. Similarly, U.S. Pat. No. 2,415,832 describes a high frequency transducer array employing a resonant backing absorber that conditions the acoustic signal. These construction techniques are effective, but due to resonance operation, are inherently narrowband.

Methods for reducing mutual coupling between transducers in an array have been applied. As known to those skilled in the art, reduced mutual coupling is beneficial since high inter-element coupling is known to degrade performance of arrays that are electronically steered. An example is described in U.S. Pat. No. 4,004,266.

Advances in acoustic baffle materials and construction methods have been used to reduce acoustic signal contamination from platform self-generated noise and to further condition an array's response. Examples include felt or wool loaded panels, decoupling materials like Corprene (Armstrong Company) and Sonite (Thermal Ceramics, Augusta, Ga.), specialty materials like Syntactic Acoustic Damping Material, or SADM, (Syntec Materials Inc., Springfield, Va.) and "Fibermetal", described in U.S. Pat. No. 4,975,799, screen baffles such as described in U.S. Pat. No. 4,669,573, air-voided composite panels and compliant tube baffles, such as those described in U.S. Pat. Nos. 4,674,595 and 5,220,535 and finally, active structure baffles, such as those described in U.S. Pat. No. 5,335,209.

The aforementioned transducer arrays and baffle technologies have various advantages and disadvantages. For example, arrays employing air-voided baffles are constrained in operation to relatively shallow depths or suffer reduced performance. Arrays using inertia plates, screen baffles, resonant absorbers, or active structures typically suffer bandwidth constraints due to the construction that are often more restrictive than the limits of the transducer. Further yet, many implementations are heavy, leading to an imbalance when transducer arrays are incorporated in ship's hull applications. Added ballast (or buoyancy) is typically required to offset the transducer array's weight.

In view of the foregoing considerations, the inventors have recognized a need for low cost, conformal, lightweight, acoustic transducer arrays for various sonar applications, such as underwater collision avoidance systems.

BRIEF DESCRIPTION OF THE FIGURES

Understanding of the present invention will be facilitated by consideration of the following detailed description of the preferred embodiments of the present invention taken in conjunction with the accompanying drawings, in which like numerals refer to like parts and in which.

DETAILED DESCRIPTION OF PREFERRED EMBODIMENTS OF THE INVENTION

Figure 1:
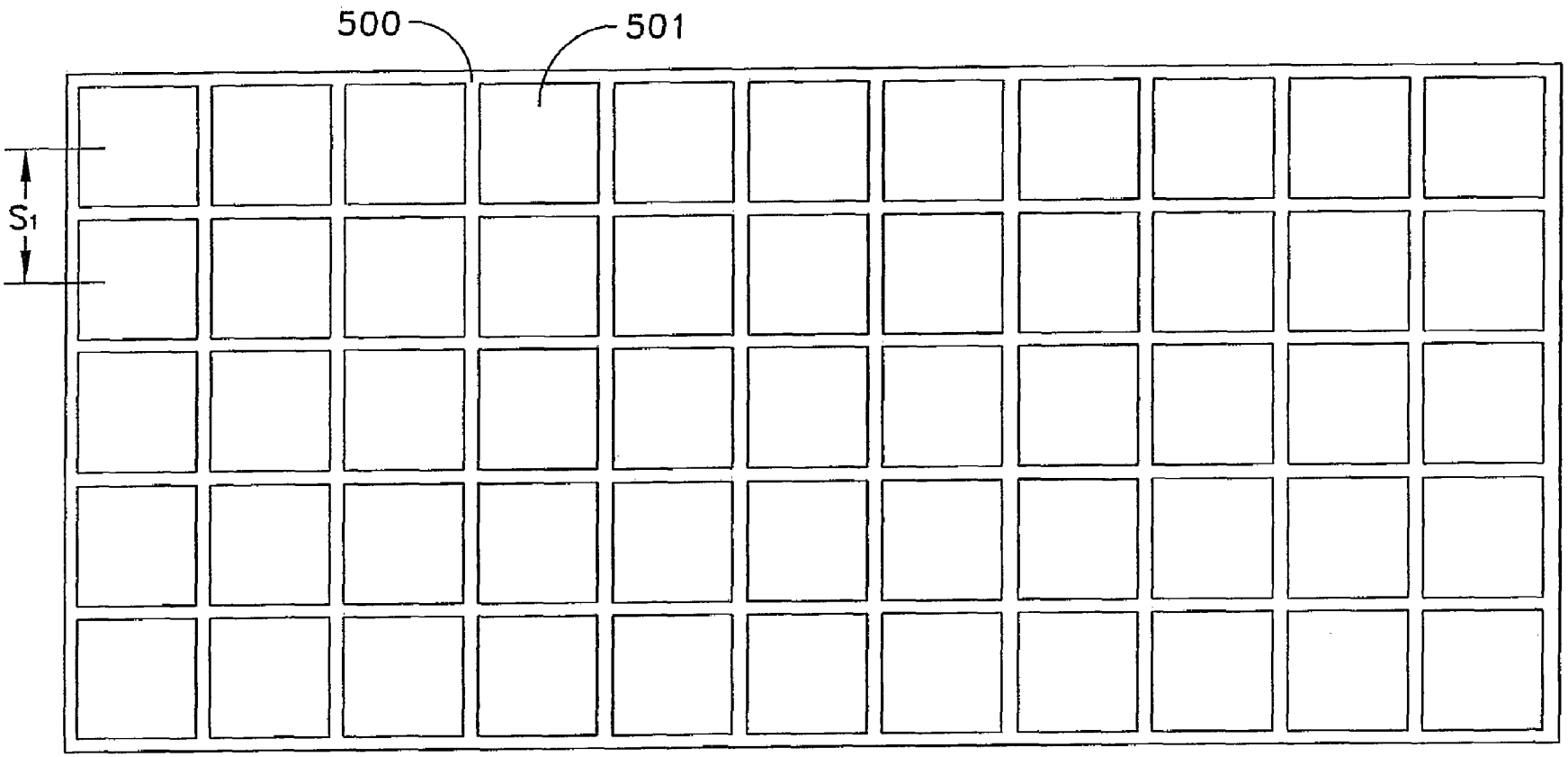
FIG. 1 illustrates a plan-view of an acoustic energy receiving surface of a typical planar or conformal acoustic transducer array.

It is to be understood that the figures and descriptions of the present invention have been simplified to illustrate concepts that are relevant for a clear understanding of the present invention, while eliminating, for purposes of clarity, many other suitably designed components found in typical sonar systems. However, because such pieces are well known in the art, and because they do not facilitate a better understanding of the present invention, a discussion of such is not provided herein. The disclosure herein is directed to all such variations and modifications known to those skilled in the art.

According to an embodiment of the present invention, an acoustic transducer array and method of baffle construction are presented to provide an improved array for use in underwater installations. In certain embodiments of the invention, exposed baffling material is constructed of an acoustically semi-rigid material and represents a majority of the array's cross-sectional area of a receiving surface of an array. For example, in certain embodiments of the present invention, the transducer surface area may represent less than about 20% of the total surface area of the energy receiving surface of the array. Additional baffling material flanking the transducers in the array may be composed of a multiplicity of lightweight layers, including Syntactic foam, for example. Accordingly, small transducers with high mass densities may be employed in a fully functional, fully populated array while still maintaining a total overall light weight. The generally incompressible nature of the transducers and associated baffle permit use over a wide range of depths with minimal degradation in performance over depth. When arrays are employed in such a manner, certain desirable performance characteristics may arise; for example, the transducer geometry and baffle construction improve the radiation pattern characteristics so that the practical angle of acceptance for incident acoustic energy increases from a typical 90 degrees to a more useful 150 degrees or greater. This aspect benefits system performance in that the array will possess a greater potential coverage area. Additionally, such a construction allows for a weight reduction from a typical 5 g/cc density to about 2 g/cc, or less, for embodiments of the invention, reducing installation impact and cost of materials.

While the exact number of transducers used and their relative locations to each other in the array may be a matter of design choice, certain geometrical configurations are particularly advantageous. For example, uniform, linear spacing between transducers allows for the use of relatively simplified signal processing algorithms. Certain embodiments of the present invention enable a substantially periodic spacing to be achieved between sub-panels in large arrays. More specifically, when a multiplicity of fully populated array panels are assembled into a larger array, the transducer size and baffle geometry eliminate any extraneous gap that typically occurs between adjacent array panels, thus lessening signal processing requirements and providing a more uniform acoustic image.

While arrays and baffles according to embodiments of the invention are adaptable to a wide range of transducers, tonpilz longitudinal resonant type transducers may be particularly well suited for use. Tonpilz type transducers are well-understood, and have a directional nature well-suited for hull mounted array panel use. They can also be made simply and inexpensively, and can be shock-hardened more easily than other types of transducers. Certain embodiments of the invention are directed towards a lightweight high frequency array employing tonpilz transducers.

Referring now to FIG. 1, there is shown a plan-view of an acoustic energy receiving surface of a typical acoustic array. Such an array includes a plurality of transducers 501 arranged in a grid fashion and is well suited for use in hydrophone applications. In the illustrated array, fifty-five transducers 501 are shown in a rectangular layout of five rows by eleven columns. Each transducer 501 may take the form of any acoustic transducer suitable for underwater use. One common type of transducer is the longitudinal vibrator or tonpilz type. A tonpilz transducer has a tail mass at a proximal end having electrical connections, a head mass at a distal end and a stack of drivers, such as piezoelectric ceramic elements, extending longitudinally between and in physical contact with the head mass and the tail mass. A tie rod maintains the stack of ceramic under compressive stress. Only the head masses of transducers 501 are shown in FIG. 1. In such an array, it is common for the center-to-center distance between transducers, $S_1$, to correspond to the design frequency of the array. Typically, this distance, $S_1$, is specified to be equal to a one half wavelength in the medium of propagation at the array design frequency. At 3000 Hz, for example, one wavelength in water is approximately 0.5 meters ($\lambda$=c/f=1500 m/s/3000 Hz=0.5 m). Thus, transducer center-to-center spacing may be 0.25 m for an array with one-half wavelength design frequency of 3 kHz.

In a two dimensional array, such as depicted in FIG. 1, it is not uncommon to have different transducer sizes and center-to-center distances along each dimension, with the benefits and disadvantages of such an arrangement being commonly understood. In addition, the interstitial region 500 between transducers 501 typically occupies 5 to 10% percent of the total cross sectional area of such an array. Conversely, the transducing area 501 occupies the remaining 90 to 95% of the total area.

Figure 2A:
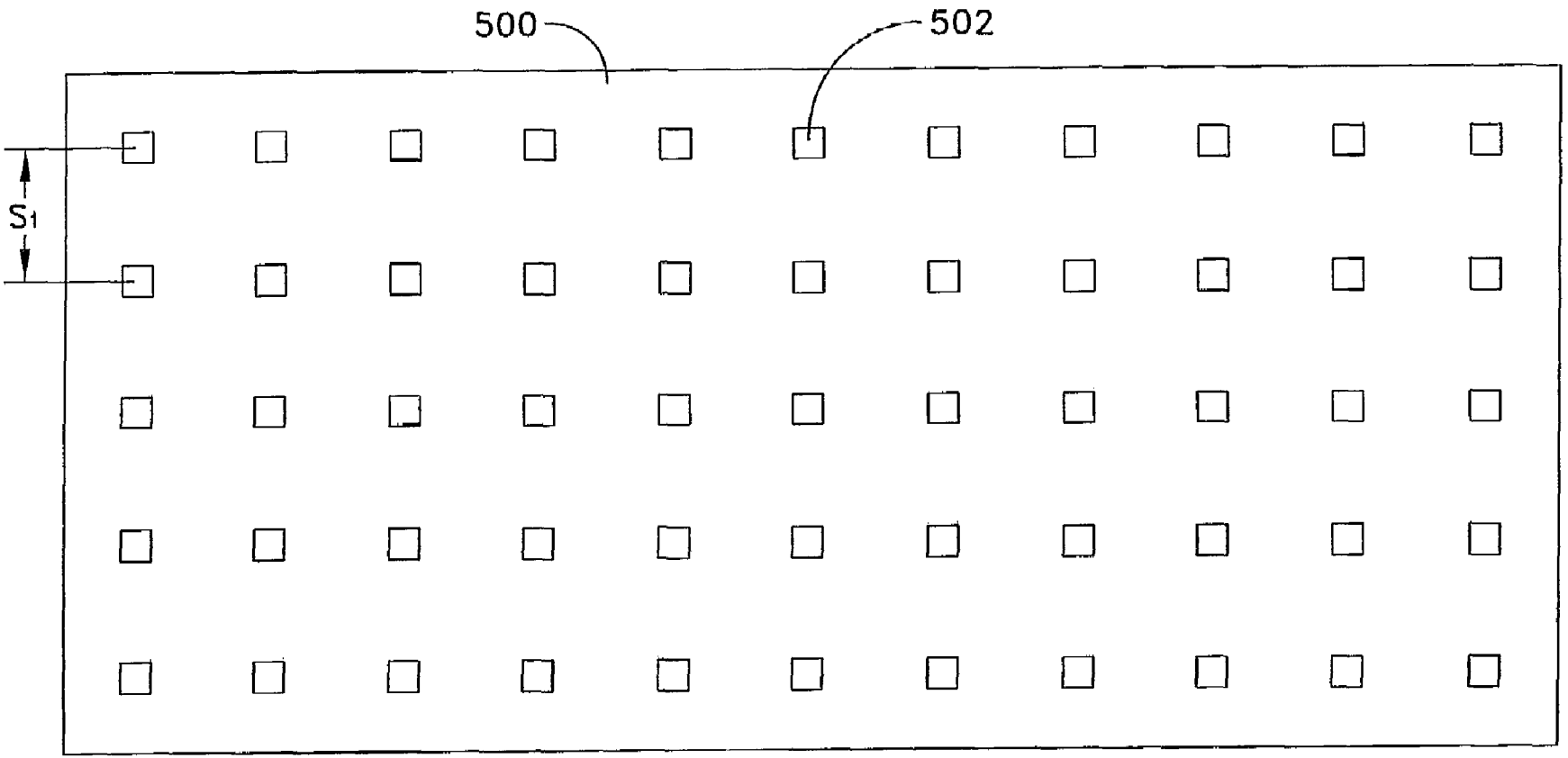
FIGS. 2*a*-2*c* each illustrate a plan-view of an acoustic energy receiving surface of an acoustic transducer array according to an embodiment of the present invention.
Figure 2B:
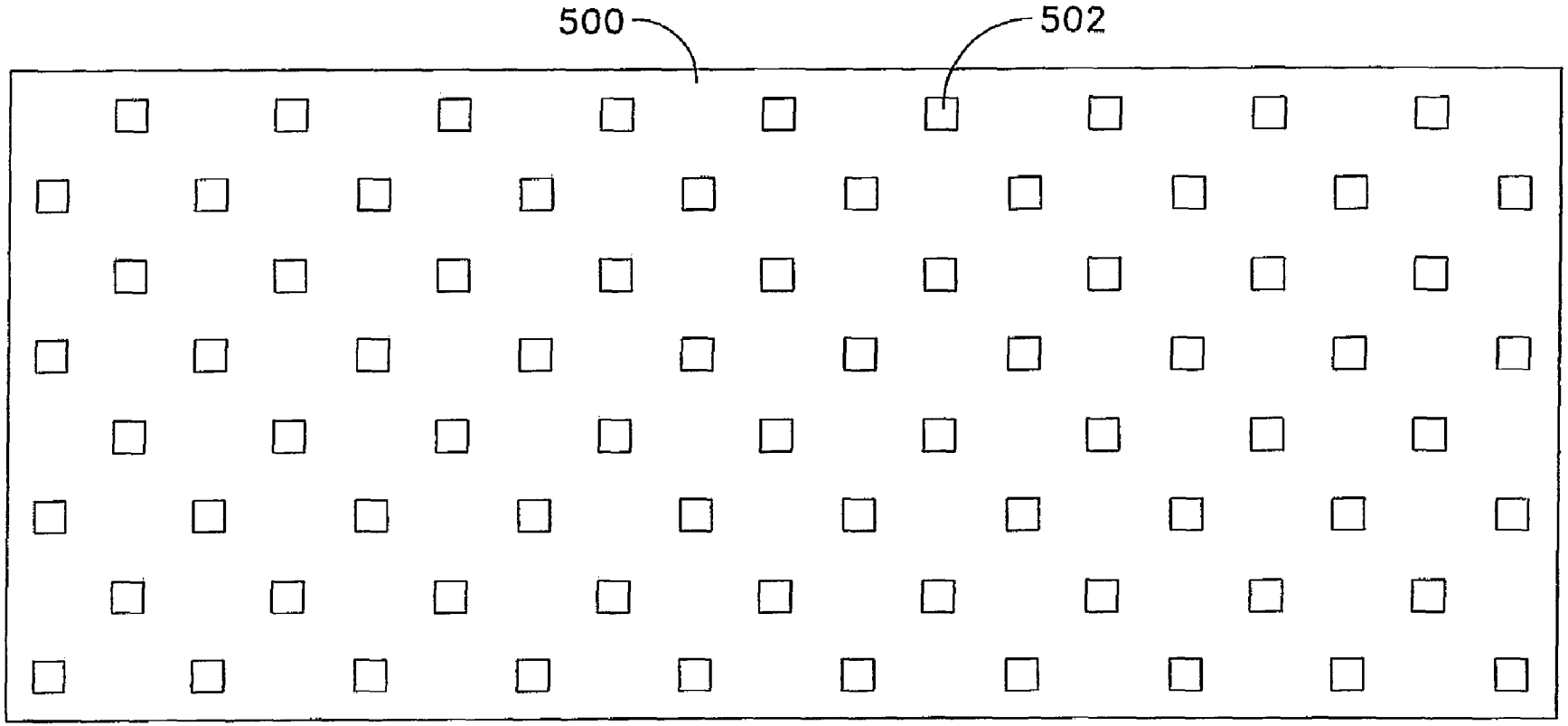
Figure 2C:
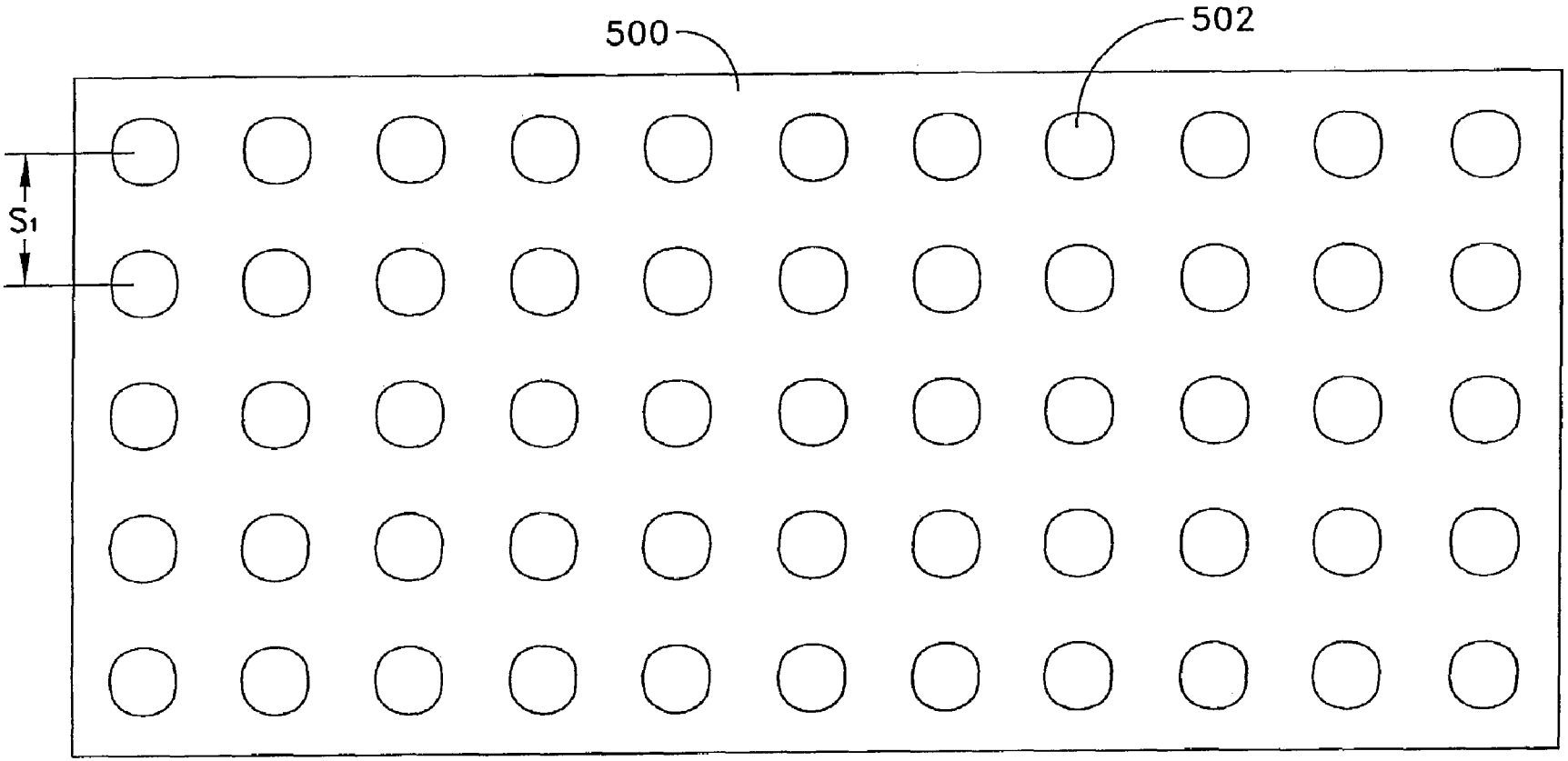

Referring now to FIGS. 2*a*-2*c*, there are shown three embodiments of arrays according to embodiments of the present invention, where transducers 502, 503 cross-sectional area has been reduced to less than about 6% (FIGS. 2*a*, 2*b*), and less than 18% (FIG. 2*c*), of the total energy receiving surface area, where this ratio of areas is based on the implementation of a normally populated array of a given design frequency. It should be understood that such configurations are distinct from other array designs, such as sparse arrays (see, e.g., U.S. Pat. No. 6,561,034), where an array is not fully populated and thus suffers from performance degradation, including effects such as loss of gain and reduced signal to noise ratio due the presence of fewer transducers and non-uniform mutual impedance caused by inconsistent spacing between transducers. Arrays according to certain embodiments of the present invention are not sparse; however, alternate embodiments of the invention may employ a sparse geometry.

Figure 7:
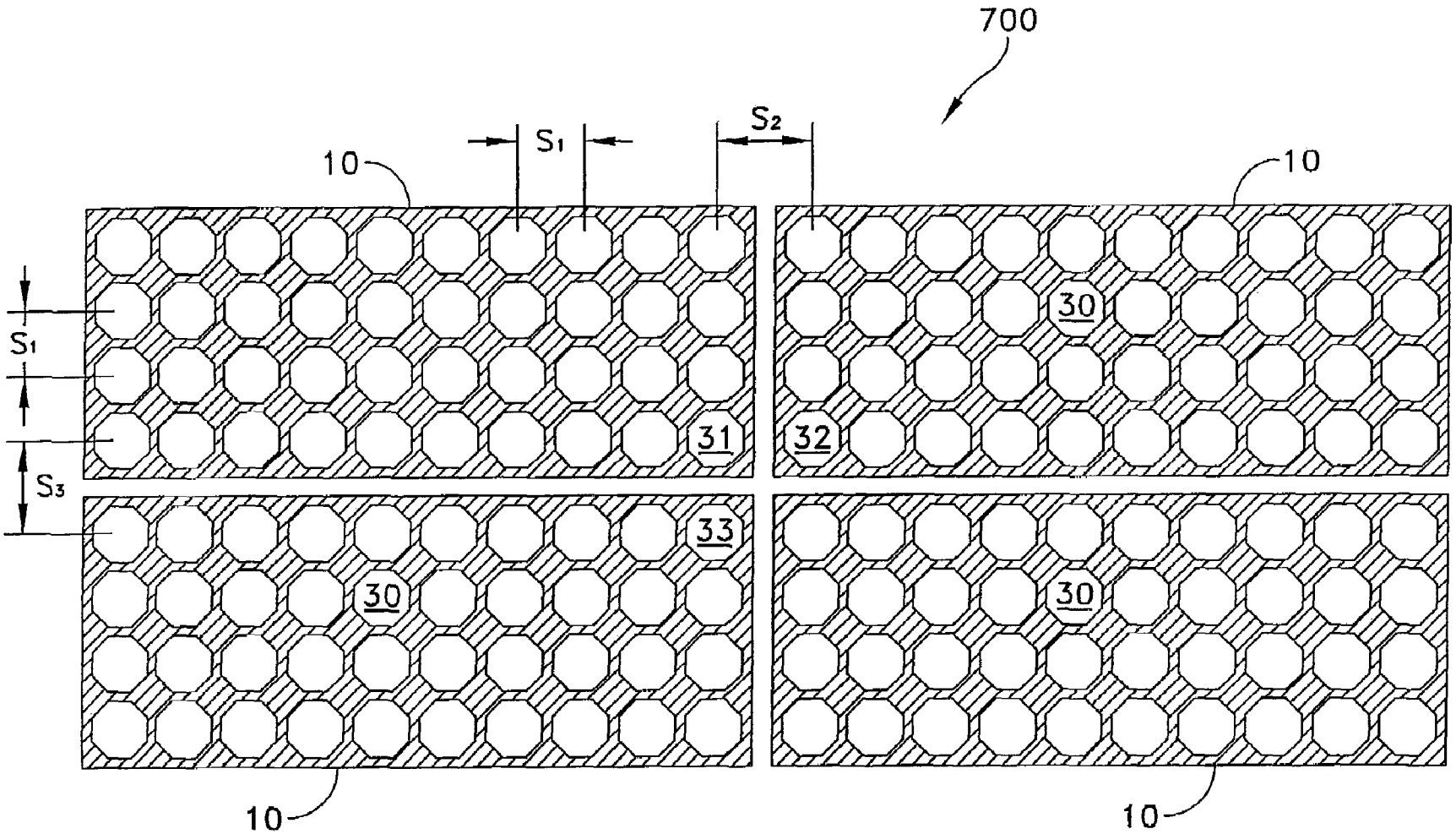
FIG. 7 illustrates a plan-view of an acoustic energy receiving surface of an acoustic transducer array.

Referring now to FIG. 7, there is shown an acoustic array 700 according to an embodiment of the present invention. Array 700 includes a plurality of arrays 10 arranged adjacent to one another. Such an implementation may be used to form a larger array, since it may be advantageous to construct large arrays from smaller array 10 modules or sub-panels. As set forth above, adjacent transducer elements 30 within a single array 10 are separated by a center-to-center distance $S_1$. By way of non-limiting example, transducer elements 30 cover the majority of distance $S_1$ in array $$700\left(S_{transducer} > \frac{S_1}{2},\right.$$

where $S_{transducer}$ is the diameter of each transducer element 30), and the center-to-center distance $S_2$ and/or $S_3$ between adjacent transducer elements of different arrays 10 (e.g., 31 and 32, and 31, 33) are greater than distance $S_1$, which is typically chosen dependent upon a desired operating characteristic, for example, a distance of one-half wavelength. Accordingly, transducer elements 10 may not be seen to be periodically spaced over array 700—leading to undesirable lobing or striping in the display image during operation of array 700, as is conventionally understood.

Figure 8:
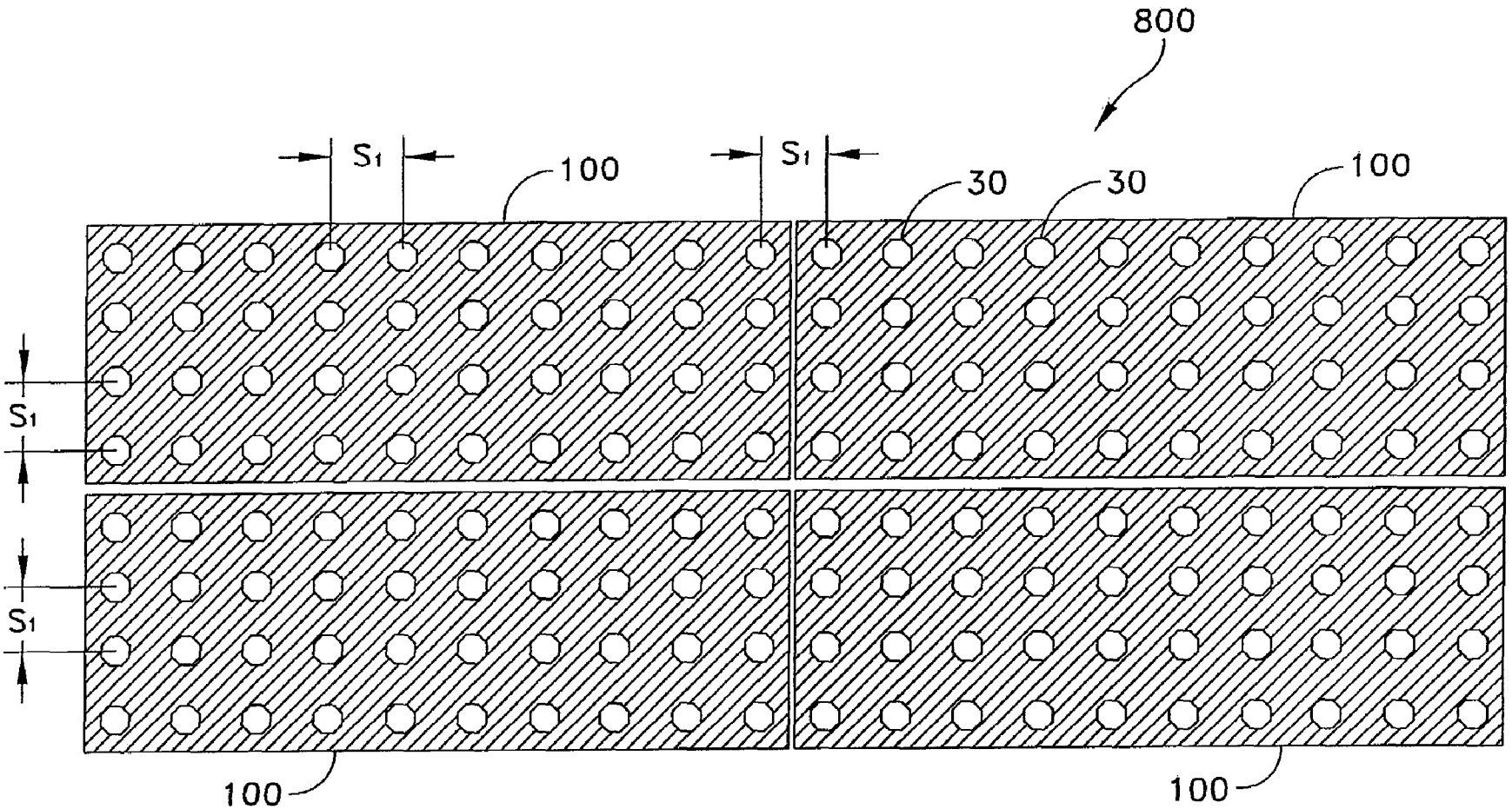
FIG. 8 illustrates a plan-view of an acoustic energy receiving surface of an acoustic transducer array according to an embodiment of the present invention.

Referring now to FIG. 8, there is shown an acoustic array 800 comprising a plurality of arrays 100 arranged next to one-another. Adjacent transducer elements 30 within a single array 100 are again separated by a center-to-center distance $S_1$. By way of further explanation, transducer elements 503 cover a minority of distance $S_1$ in array 800, and the center-to-center distance between adjacent transducer elements 30 in adjacent arrays 100 is substantially identical to distance $S_1$. Accordingly, transducer elements 30 may be seen to be periodically spaced over the entire array 800—mitigating lobing and image striping during operation, as is conventionally understood.

Figure 9:
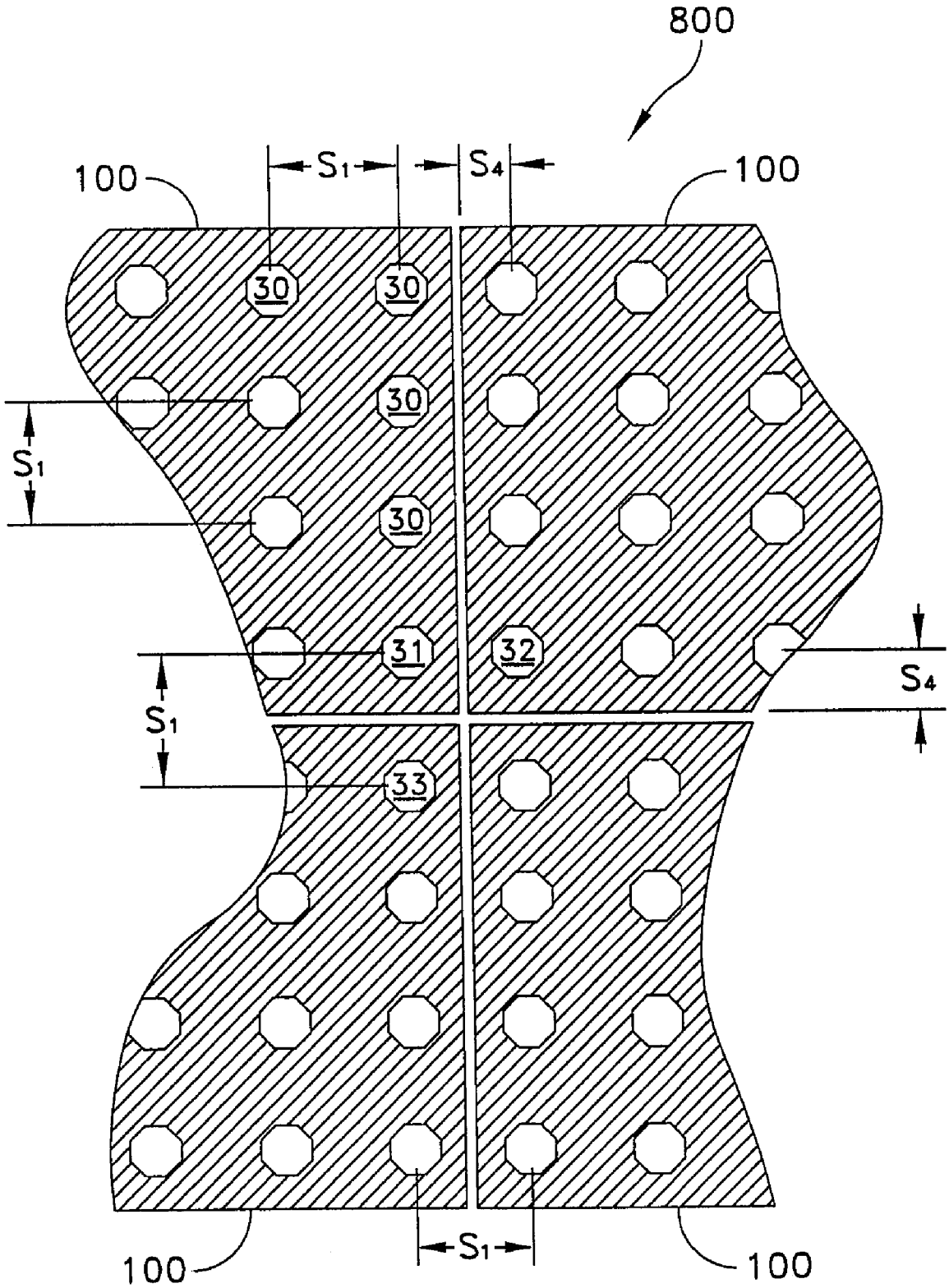
FIG. 9 illustrates an enlarged partial view of the array of FIG. 8.

Referring now also to FIG. 9, there is shown an enlarged view of a portion of an array 800 incorporating multiple panels 100. Again, as can be seen therein, adjacent transducer elements 30 in a same array 100 are separated by a center-to-center spacing $S_1$. And, adjacent transducer elements in different arrays 100 are also separated by center-to-center spacing $S_1$. In the illustrated embodiment:

$$S_1 = \frac{S_4 + \text{gap}}{2},$$

where gap is ½ of the spacing between adjacent arrays 100. It should be understood that this is not achieved in array 700 of FIG. 7, where $$S_{transducer} > \frac{S_1}{2},$$

where $S_{transducer}$ is the diameter of each transducer element 30. Thus, array 800 may be seen to mitigate lobing and striping inherent to array 700.

Figure 3:
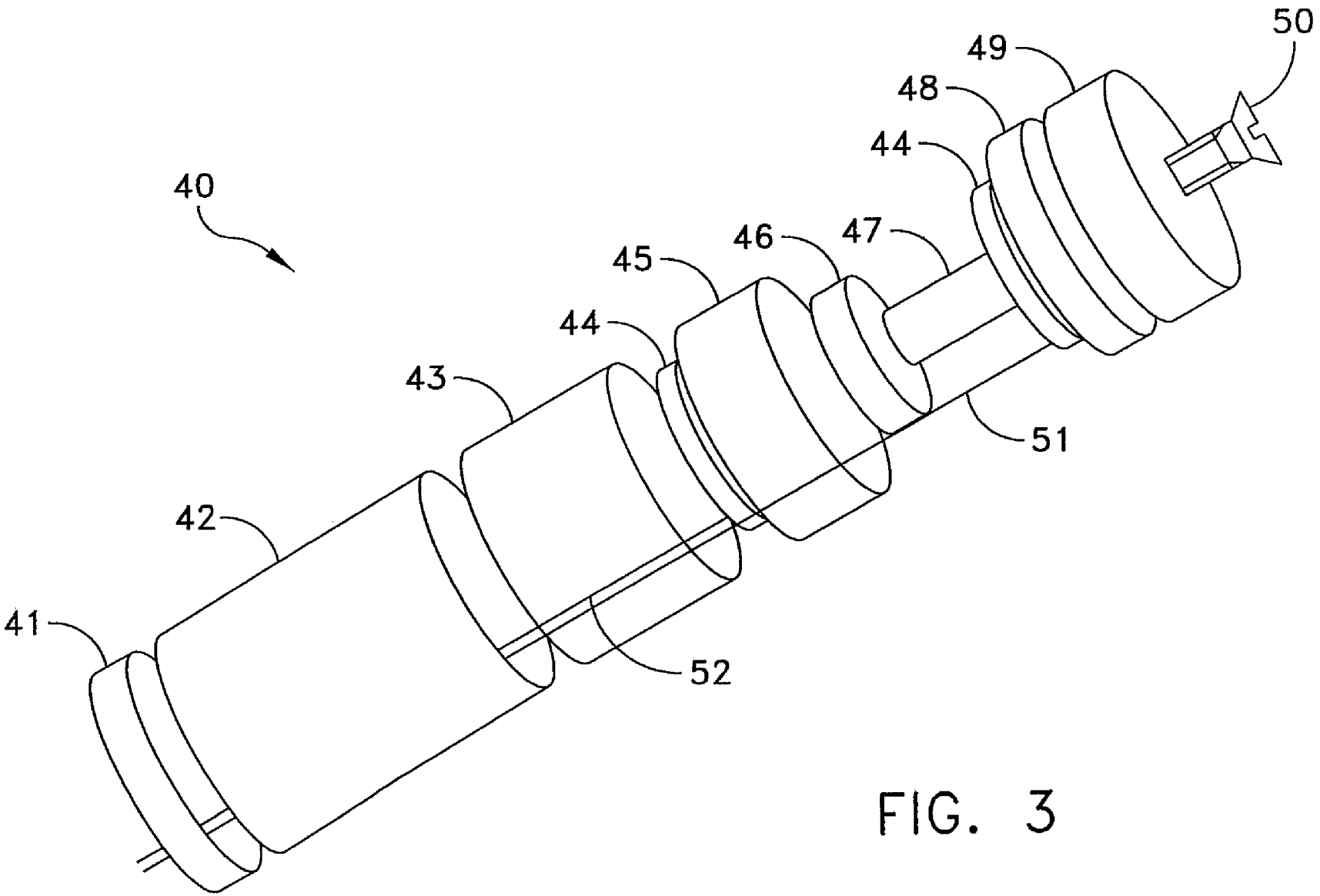
FIG. 3 illustrates a partially exploded view of a tonpilz longitudinal resonator type transducer.

Referring again to FIGS. 2*a*, 2*b* and 2*c*, such embodiments may be realized by employing tonpilz style transducers, such as those exemplified by FIG. 3. Referring to FIG. 3, there is shown a partially exploded view of a transducer 40 suitable for use as elements 502, 503. Transducer 40 has a tail mass 43 and receives electrical connections 51, 52 through a bottom plug 41. The bottom plug may be composed of Corprene or other suitable isolation material. Transducer 40 also includes a head mass 49 that is exposed to acoustic waves to be sensed, a bulk driver, or a stack of ring shaped drivers, such as one or more piezoelectric ceramic elements 46 electrically connected in parallel, extending longitudinally between and in physical contact with the head mass 49 and tail mass 43. The piezoelectric ceramic 46 may be composed of a high coupling and high capacitance lead zirconate titanate (PZT) material commercially available from, for example, Lockheed Martin Corp. Syracuse, N.Y. or TRS Technologies, State College, Pa. Tailmass 43 may be composed of steel and the headmass 49 composed of aluminum. Electrodes 44 are affixed adjacent to driver 46. A tie rod 50 maintains the stacked elements under compressive stress. The tie rod wrap 47 insulates the stack from the tie rod 50. The wrap 47 may be composed of polyvinyl chloride (PVC) or polyethylene. The driver wrap 45, which may be composed of Corprene or other similar material, acoustically isolates the driver 46. Washer 48 electrically insulates the headmass 49 from the electrode 44. It may also be utilized to provide mechanical resonance tuning as understood by those skilled in the art. Depending on specific application, washer 48 may be composed of materials such as alumina or fiberglass. Wrap 42 provides further isolation of transducer 40. Wrap 42 may be composed of Corprene or other similar material.

Figure 4A:
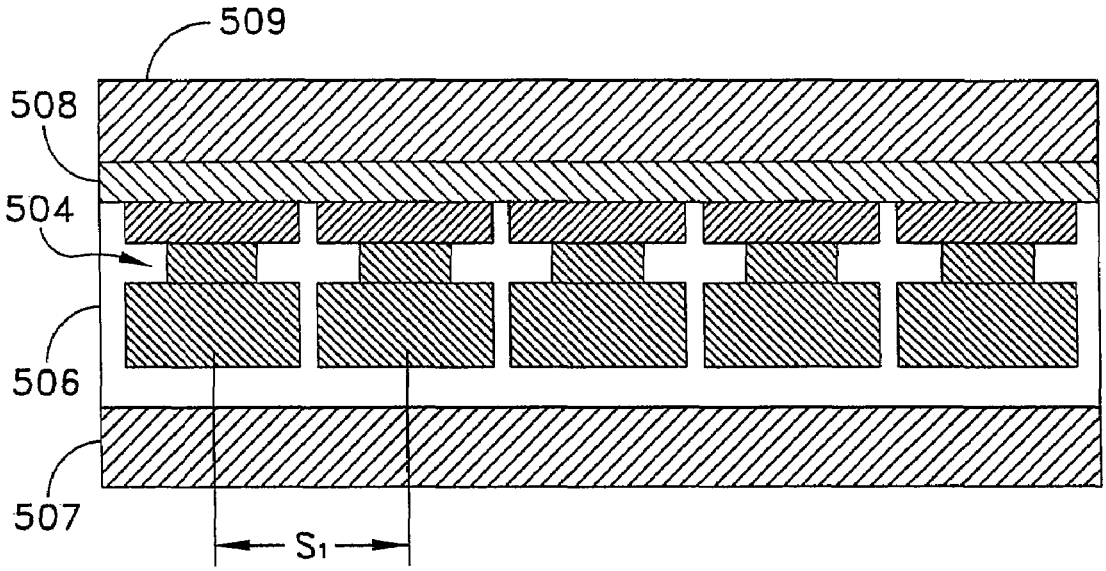
FIGS. 4*a* and 4*b* illustrate cross-section views of typical arrays.
Figure 4B:
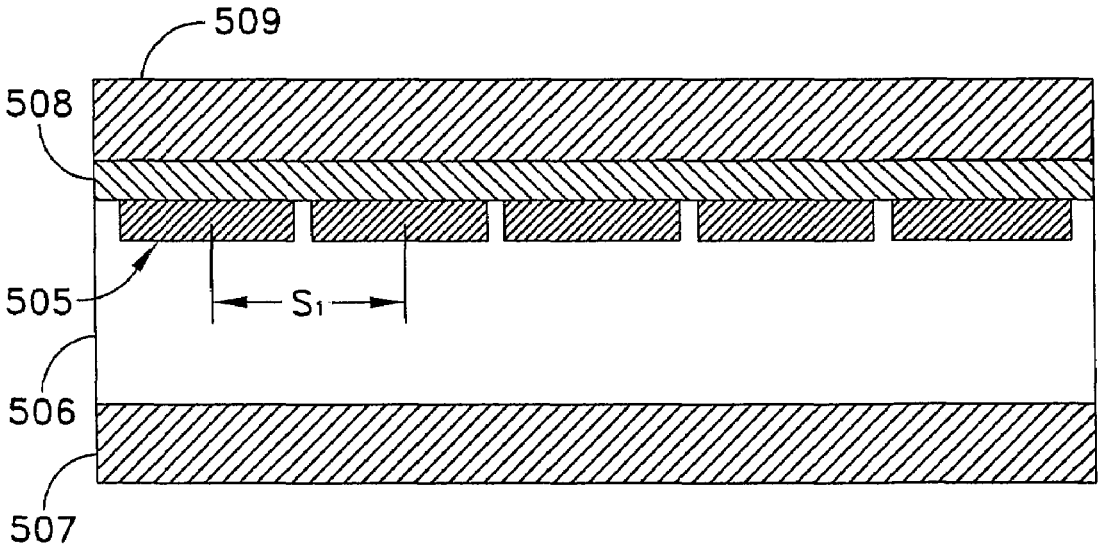

Referring now to FIGS. 4*a*-4*d*, there are shown cross-section views of various conformal array assemblies. A typical array, as shown in FIG. 4*a*, may have tonpilz transducers 504, such as previously described and depicted in FIG. 3. Tonpilz transducers are particularly advantageous in conformal arrays because of the inherent directional nature provided by their built-in tailmass. The higher immunity to back lobe interference provided by the tailmass remains across operating depth. However, other transducer types may be employed. For example, FIG. 4*b* shows a typical array having solid, spherical, cylindrical, or composite transducers 505. Array configurations similar to FIG. 4*b* may show degraded performance as depth increases, though.

Construction of an array may include mounting an acoustically absorbent substrate 506 to signal conditioning and mounting plate 507, followed by installation of transducers 504 or 505. Suitable signal conditioning plates are made from structural materials possessing good strength and high acoustic impedance for example, steel. The mounting and signal conditioning plate may be affixed directly to a vessel's hull, to suitable vibration isolators and associated sonar baffling, or to a housing containing transducer electronics, for example. The acoustically absorbent substrate may be made from a variety of materials; one example being SADM. Such a material serves to isolate the transducers from noise generated by the vessel on which they are installed.

Disposed over transducers 504, 505 may be a cover 508 for water blocking, impedance matching, and/or encapsulation purposes. Cover 508 may be formed of a material such as (but not limited to) polyeurathane, a rubber such as neoprene rubber, butyl rubber, or fiberglass, for example. An acoustically transparent window 509 may then be installed for separation of the transducer from a turbulent boundary layer as is understood by one of ordinary skill in the art. Such window 509 may be formed of a thin layer of steel, fiberglass, rubber or composite material such as an elastomer, all by way of example only. Such a window has been shown to improve array performance by reducing flow noise reaching the transducer, as has been discussed in Ko and Schloemer, JASA, April 1989.

Figure 4C:
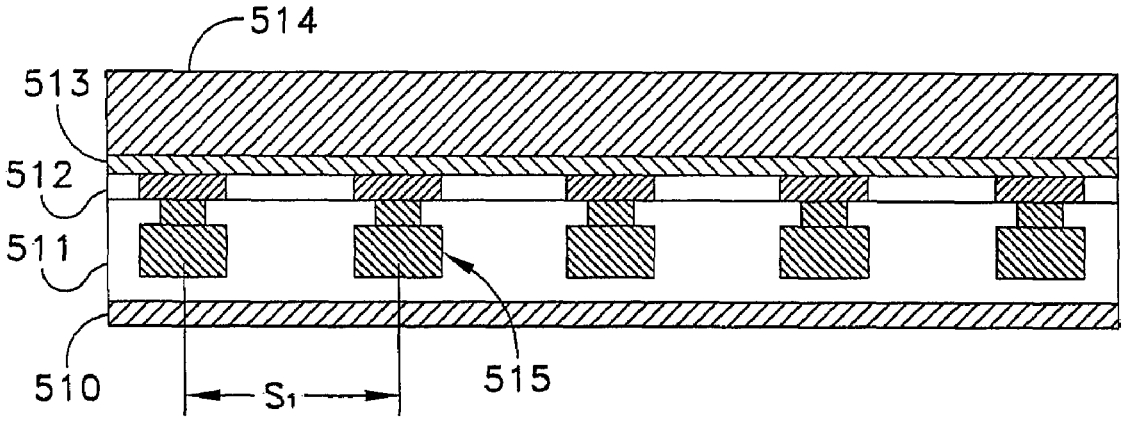
FIGS. 4*c* and 4*d* illustrate cross sectional views of arrays according to embodiments of the present invention.
Figure 4D:
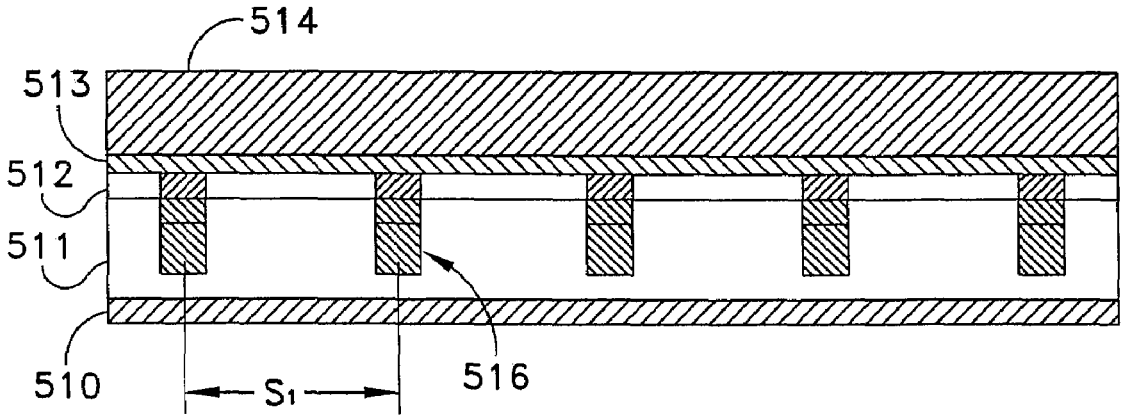

FIGS. 4*c*-4*d* illustrate embodiments of the present invention, where a reduction in array weight and improved in acoustic performance may be achieved. For example, the heavy signal conditioning plate 507 is replaced by a lightweight composite isolator 510, such as a Corprene-Aluminum sandwich. The relatively dense absorbent substrate 506 is replaced by a lightweight composite comprising a layer of incompressible, acoustically transparent material 511, such as syntactic foam and a thin layer of semi-absorbent capping material 512. To minimize the acoustic impact of the syntactic foam layer 511 and to maintain its acoustic transparency, it may be kept thin, as is discussed in Madigosky and Fiorito, JASA May 1979, in which the maximum thickness for a given operational frequency can be calculated. The material 512 capping the syntactic foam forms a semi-rigid baffle condition for the transducers in the array. If material 512 realizes an acoustically rigid baffle condition, incident acoustic energy impinging on the baffle may cause a reflected wave to be generated that is in phase with the incident wave at the surface, such that a gain in sensitivity may be realized. The gain in sensitivity is achieved usually at the cost of a non-uniform acoustic pressure distribution across the face of the array, thus resulting in generally degraded uniform and wide bandwidth array response. Also, as a fully rigid baffle, transverse acoustic waves can propagate within the rigid layers of the baffle and generate interference that is spatially correlated across the array, further hampering performance.

Figure 6B:
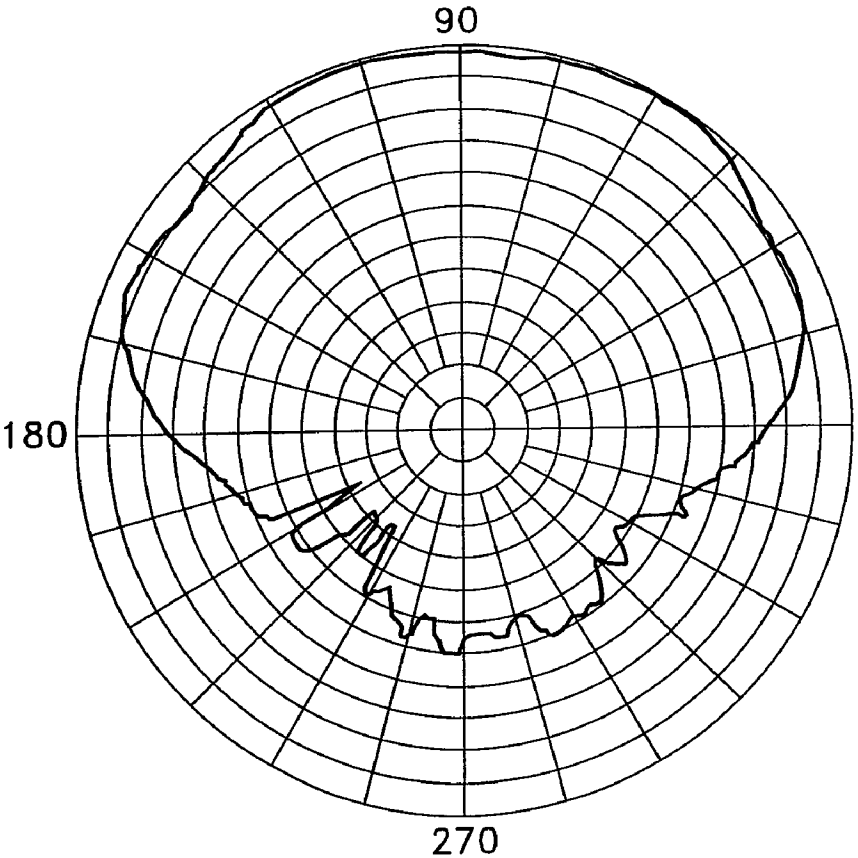
FIG. 6*b* illustrates radiation pattern characteristics for a transducer according to an embodiment of the invention when measured at the array design frequency.

On the other hand, if material 512 capping the syntactic foam is chosen as a highly absorptive material, such as the case of applying a layer of pressure release material like Corprene, the incident acoustic wave is sufficiently attenuated such that the effective transducer output is severely diminished. The application of SADM for the material 512 is advantageous because it is not fully rigid nor is it highly absorbent. In addition, it has a non-uniform, nearly random structure that disrupts the periodicity of deleterious transverse waves. Benefits of this unique baffle configuration can be further understood by examining the measured acoustic responses shown in FIGS. 6*a-b*.

Figure 6A:
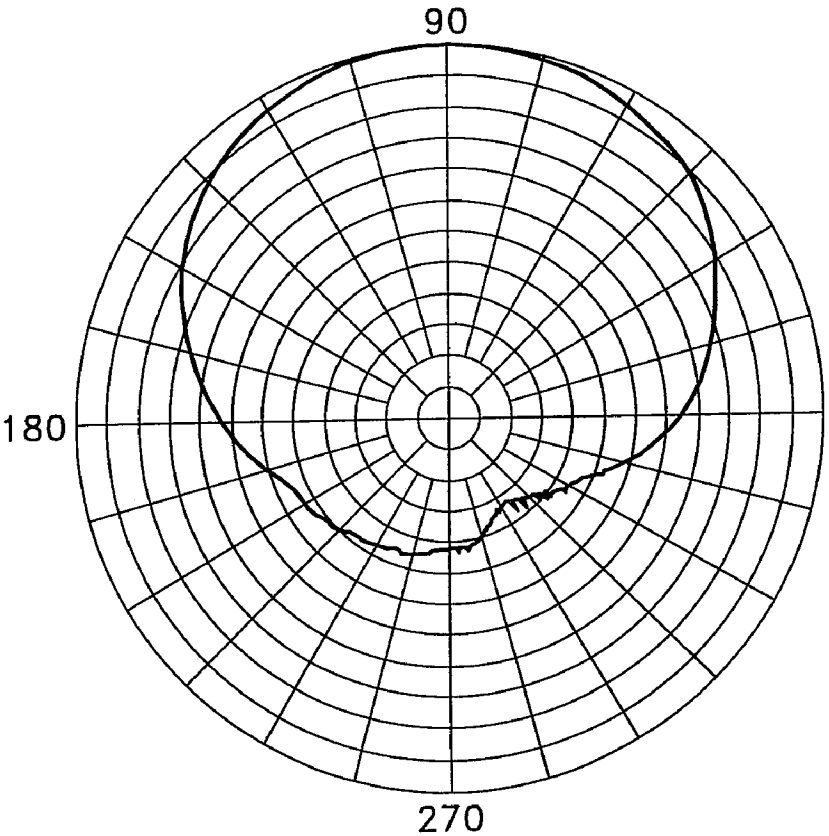
FIG. 6*a* illustrates radiation pattern characteristics for a conventional single transducer when measured at the array design frequency.

FIG. 6*a* illustrates a radiation pattern for a single transducer obtained from the prior art transducer array of FIG. 1 and FIG. 4*a*, at the array design frequency. The transducer's radiation response peaks at 90 degrees, the angle normal to the face of the array. At angles away from the normal, the radiation response gradually decreases. Commonly, the transducer's beamwidth is used to help define the practical range of angles in which the array can be operated. With the chart axis set at 5 dB per division, the FIG. 6*a* beamwidth is seen to be 90 degrees at the −6 dB point. In contrast a single transducer radiation pattern corresponding to the embodiments of FIGS. 2*c* and 4*c* shows particularly advantageous beamwidth characteristics. Beamwidths are 150 degrees at the −6 dB point. It is also notable that these beamwidths are maintained within 20% across an excess of two octaves of frequency. This represents an increase in the angle of acceptance to the array and a marked increase in the obtainable sensing volume of a phased array. The narrower radiation patterns of the prior art arrays, such as that of FIG. 1, can be partially explained by the larger relative size of an individual transducer's radiation surface. The larger surface increases the inherent directivity index of the transducer and reduces beamwidth. This effect becomes more pronounced as the transducer's width exceeds for example, one-half wavelength. Additionally, the larger ratio of transducer cross sectional area to array cross sectional area causes the baffle condition to more closely approximate a rigid baffle, thus increasing the effective directivity of the transducer and decreasing its beamwidth. Unlike the increased directivity resulting from a larger transducer, this effect is relatively independent of size and always less than 3 dB.

Further improvements may be obtained by replacing matching layer 508 with a thin encapsulation-only layer 513, thus reducing volume and weight. Encapsulation-only layer 513 may be composed of a waterproofing material such as molded polyeurathane, by way of example only. The window layer 514 may be essentially unchanged in the embodiments of the present invention shown in FIGS. 4*c* and 4*d* relative to that of FIGS. 4*a* and 4*b*, as an appropriate thickness and acoustic impedance may be maintained to preserve desirable performance characteristics. Since a transducer may be comprised of dense materials such as piezoelectric ceramic and steel or tungsten, a significant portion of array weight results from transducer weight. The average density of a typical transducer is approximately 5 g/cc. Transducer contributed volume and weight may be reduced by 75 and 93 percent from the typical configuration of FIG. 4*a* to specific embodiments of the invention illustrated in FIG. 4*c* and FIG. 4*d*. Similarly, density of the signal conditioning plate 507 is reduced from 7 g/cc to 2 g/cc in 510. Density of the transducer substrate 506 has been reduced from 2 g/cc to 1 g/cc in 511 and 512. Overall array density, excluding mechanical housings and transducer electronics has been reduced from a typical 5 g/cc in the prior art to 2 g/cc as realized by configurations constructed in the manner of the preferred embodiment of the array 100. Additionally, aspects of the invention configured such as is illustrated by FIGS. 2*a-b* and FIG. 4*e* have been constructed in the manner described to achieve array density less than or equal to 1 g/cc. Thus, such aspects are buoyant or neutrally buoyant in water, providing significant advantages in conformal array installations.

Figure 5:
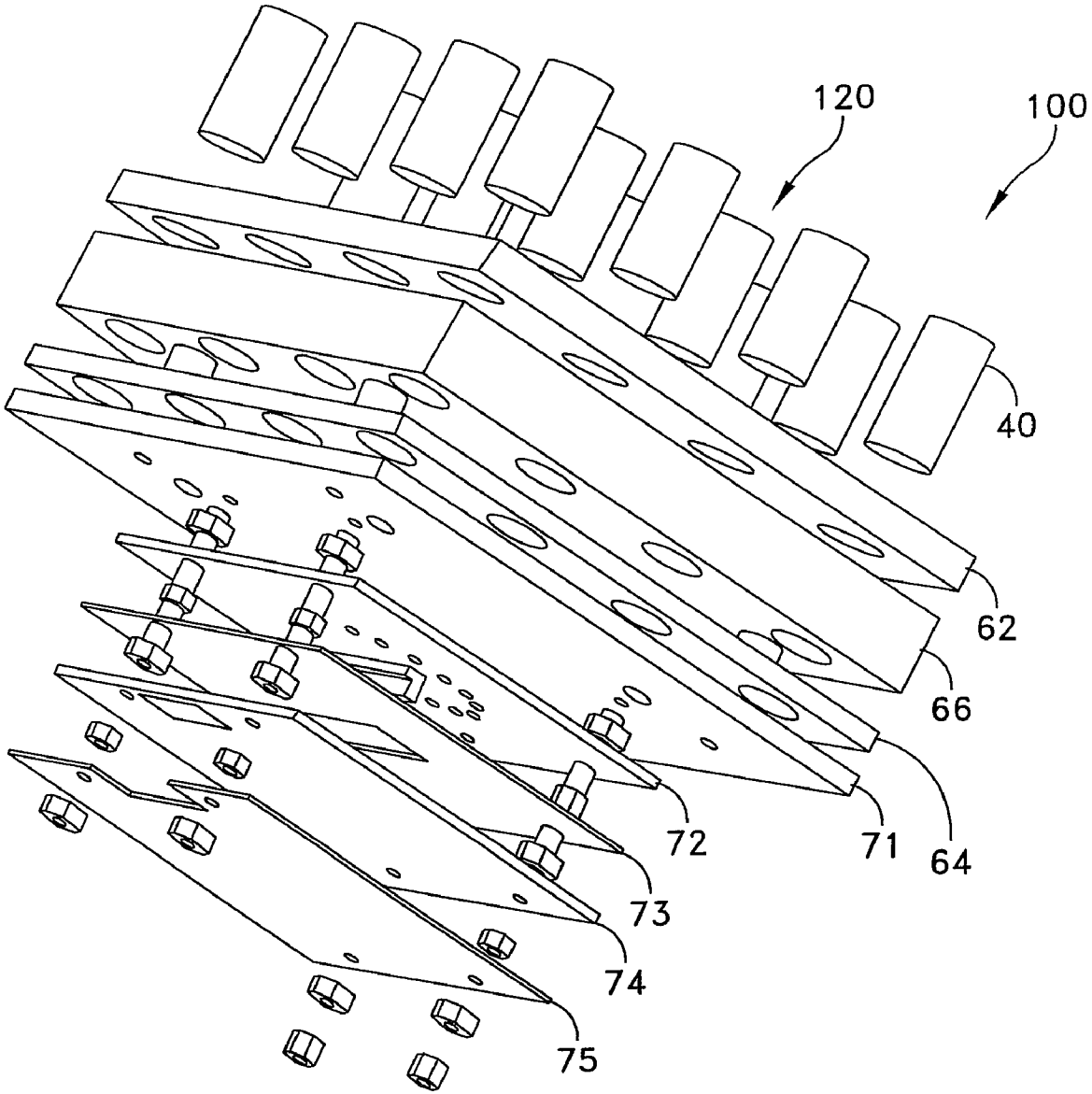
FIG. 5 illustrates a perspective view of an acoustic energy transducer array according to an embodiment of the present invention.

Referring now also to FIG. 5, there is shown a perspective view of array 100 according to an embodiment of the present invention. Array 100 includes transducers 40 and baffling layers 62, 64, 66 comprising baffle material such as syntactic foam, Corprene or other such buoyant baffle material as discussed herein and mounted to a mounting plate 71. For example, such baffle layer materials may include multiple layers of syntactic acoustic damping material and a syntactic foam. The syntactic foam may be predominantly acoustically transparent. The baffling material layer may further comprise a metallic layer. The baffle material is preferably a material having anechoic properties for the particular application. The baffling layer(s) may comprise fiberglass, fiber reinforced foam, glass reinforced plastic, or similar composite layer. A pressure-release decoupling layer, such as Corprene may be formed interior to the composite layer. Mounting plate 71 may take the form of a thin sheet of titanium, for example. Plate 71 may also support an interface card 72 (that is coupled to and powers, and receives signals from, connections 51, 52, for example), a signal conditioning and communications card 74, and electromagnetic shields 73, 75. In the embodiment of the invention illustrated in FIG. 5, amplitude and phase response of channels in the array is linear in a 3 octave band of operation with noise equalization and filtering applied. Channel linearity and the constant beamwidth characteristics illustrated by FIG. 6*b* simplify implementation of passive broadband sonar systems. The reduced transducer size facilitates device resonant frequencies outside of the operating frequency band which further facilitates a linear response. The reduced size of the present invention also improves the channel phase accuracy in an assembled device.

For example, a close positional tolerance can be maintained during array assembly. The smaller fractional size of the transducer ensures that its acoustic phase center is more likely to be positioned at the theoretical location. Better alignment improves system signal to noise ratio and detection capability when conventional array processing techniques are employed. High sensitivity transducers and low noise signal conditioning ensures that resultant channel noise levels are below ambient levels.

It will be apparent to those skilled in the art that modifications and variations may be made in the apparatus and process of the present invention without departing from the spirit or scope of the invention. It is intended that the present invention cover the modification and variations of this invention provided they come within the scope of the appended claims and their equivalents.

What is claimed is:

1. A high frequency underwater acoustic transducer array comprising:

an acoustic energy receiving surface having a normally populated array of transducer elements contained in an acoustically exposed baffle;

wherein, the majority of the acoustic energy receiving surface is formed by the acoustically exposed baffle; and wherein said baffle includes a multilayer composite comprising an acoustically transparent layer of syntactic foam and a layer of syntactic acoustic damping material and Corprene.

2. The array of claim 1, wherein the baffle further comprises a metallic layer.

3. The array of claim 1, wherein the baffle further comprises an anechoic material.

4. The array of claim 1, wherein the baffle comprises at least one of fiberglass, fiber reinforced foam and glass reinforced plastic.

5. The array of claim 4, wherein the baffle further comprises a pressure-release decoupling layer.

6. The array of claim 1, wherein the baffle is buoyant.

7. The array of claim 1, wherein the baffle is substantially incompressible.

8. The array of claim 1, wherein the baffle is acoustically semi-rigid.

9. The array of claim 1, wherein each transducer element is a tonpilz type transducer.

10. The array of claim 9, wherein each transducer comprises a steel tail mass.

11. The array of claim 10, wherein each transducer comprises an aluminum headmass positioned substantially coplanar with the baffle, wherein the baffle and head masses form the acoustic energy receiving surface.

* * * * *